United States Patent [19]

Sekerich

[11] Patent Number: 4,516,813

[45] Date of Patent: May 14, 1985

[54] CABINET DOOR MOUNTING MECHANISM

[75] Inventor: Michael Sekerich, Spring Valley, N.Y.

[73] Assignee: Grant Hardware Company, Wesy Nyack, N.Y.

[21] Appl. No.: 483,920

[22] Filed: Apr. 11, 1983

[51] Int. Cl.[3] ..... A47B 87/02

[52] U.S. Cl. ..... 312/323; 312/109

[58] Field of Search ..... 312/138, 109, 322, 323; 16/288, 291, 294, 302, 370; 49/197, 254

[56] References Cited

U.S. PATENT DOCUMENTS

| | | | |
|---|---|---|---|
| 3,771,847 | 11/1973 | Aylworth | 312/138 |
| 3,968,540 | 7/1976 | Lautenschlager et al. | 16/370 |
| 4,319,382 | 3/1982 | Zernig | 16/297 |

*Primary Examiner*—Francis K. Zugel
*Assistant Examiner*—Joseph Falk
*Attorney, Agent, or Firm*—Howard C. Miskin

[57] ABSTRACT

A cabinet door in its closed position depends from the cabinet top wall and is coupled to a follower slidably engaging a longitudinal track on the top wall underface so that the door may be swung upwardly open and retracted into the cabinet. The follower and track have longitudinal races embracing retainer holding balls. The coupling mechanism includes an anchor on the door having transversely spaced first and second hinge pins and a bracket on the follower having third, fourth and fifth transversely spaced hinge pins and links extending between the first and third and second and fourth hinge pins and a leaf spring extending between the second and fifth hinge pins so that the door is swingable between a closed position perpendicular to the top wall and an open position parallel to and below the top wall and when approaching closed position is spring urged to close. Alternatively, the track and anchor positions are reversed so that the door in its open position overlies the top wall.

3 Claims, 18 Drawing Figures

CABINET DOOR MOUNTING MECHANISM

BACKGROUND OF THE INVENTION

The present invention relates generally to improvements in hinged slide structures and it relates particularly to an improved open front cabinet with a hinged retractable door.

Open front cabinets provided with hinged closure doors are widely used not only domestically but commercially and industrially such as in open plan furniture systems, institutional furniture, laboratory furniture, audiovisual furniture and file and storage systems, However, the cabinet structures heretofore available or proposed possess numerous drawbacks and disadvantages. The mechanisms supporting the door and the movement and paths of the moving door and the manipulation and operation of the doors leave much to be desired. The manipulation and operation of the doors are often difficult and awkward, access to the open cabinet is inconvenient, the space requirements are high and the door mounting mechanisms are unreliable and of little versitility and adaptability.

SUMMARY OF THE INVENTION

It is a principal object of the present invention to provide an improved hinged slide mechanism.

Another object of the present invention is to provide an improved door mounting hinged slide mechanism.

Still another object of the present invention is to provide an improved cabinet structure having a swingable retractable door.

A further object of the present invention is to provide an improved structure of the above nature characterized by its reliability and ruggedness, ease and convenience of operation, low space requirements and great versitility and adaptability.

The above and other objects of the present invention will become apparent from a reading of the following description taken in conjunction with the accompanying drawings which illustrate preferred embodiments thereof.

A hinged slide structure in accordance with the present invention includes a first panel, a longitudinally extending track affixed to the first panel, a follower retained by the track and longitudinally slidable betweeen advanced and retracted positions, a second panel and a hinge mechanism connecting the follower and second panel permitting the swinging of the second panel about [a] transverse axis between a position perpendicular to the first panel and a position parallel to the first panel.

In the preferred form of the improved structure as applied to the mounting of a door to the open front of a cabinet, the first panel being rectangular and defining the door and the second panel likewise being rectangular and defining the cabinet top wall, the track is a vertical channel affixed to the inside face of the door and having grooved side legs defining confronting races. A retainer carrying balls engaging the track races nests in the track and the follower nests in the ball carrying retainer and has outside longitudinal races engaging the balls. The hinge mechanism includes a bracket adjustably mounted on the follower, an anchor member affixed to the forward border of the cabinet top wall inside face, a parallelogram linkage connecting the bracket and anchor member and an outwardly bowed leaf spring extending between the bracket and anchor member to effect the separation of the proximate edges of the door and top wall panels as the door is swung from its relatively perpendicular position and to bias the door to its perpendicular position when the angle between the panels is less than a predetermined value. Alternatively, the track may be affixed to the cabinet top wall inside face and the anchor member to the door in which arrangement the door is retracted along the top wall inside face in contrast to the first arrangement in which the door is retracted along the cabinet wall top face. A roller stop is supported by the first panel and is positioned to restrict the swinging of the door to a vertical position and to support the longitudinally moving door.

The improved hinged slide structure is relaible and rugged, easy and convenient to use and operate, of little space consumption and of great versitility and adaptability.

DESCRIPTION OF THE PREFERRED EMBODIMENTS

Figure 1:
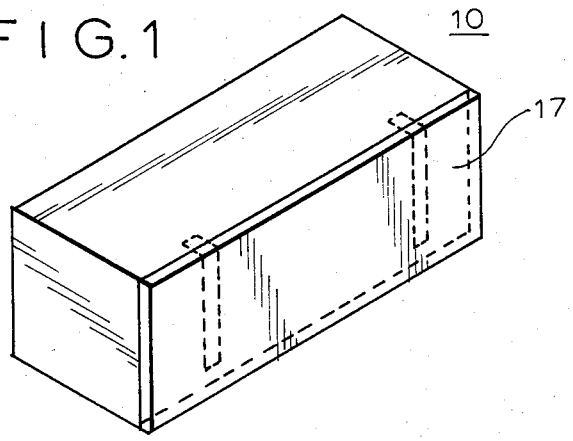
FIG. 1 is a front perspective view of a cabinet in accordance with a preferred embodiment of the present invention, the cabinet door being shown in closed position.
Figure 2:
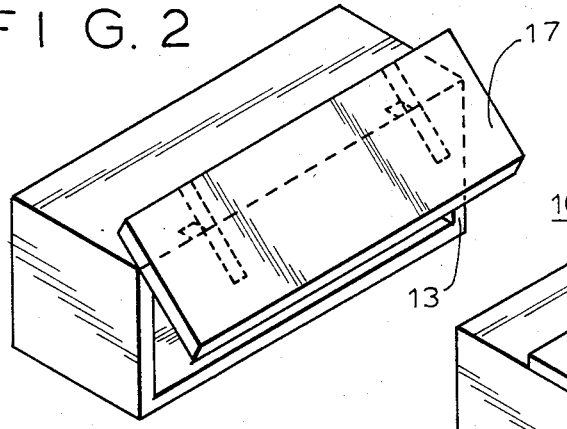
FIG. 2 is a front perspective view thereof with the door being shown in partially open position.

Referring now to the drawings, particularly FIGS. 1 to 9 thereof which illustrate a preferred embodiment of the present invention as applied to a cabinet having a front door swingable about an upper transverse axis from a vertical closed to a horizontal open position above the level of the cabinet top wall and retractable along the top wall outside face, the reference numeral 10 generally designates the improved cabinet which includes a body member 11 having a rectangular top wall 12, rectangular side walls 13 and a bottom wall 14, the front edges of walls 12, 13 and 14 delineating a rectangular front opening 16 to cabinet 10. A rectangular lid or door 17 having the same perimeter as that defined by the outside edges of walls 12, 13 and 14 is, in the manner hereinafter described, connected to top wall 12 so as to be swung from its vertical closed position registering with opening 16 to a horizontal [open] position above top wall 12 and then retracted to overly top wall 12.

A pair of laterally spaced channel shaped tracks 18 are affixed by screws 15 to the inside face of door 17 and extends longitudinally between the door top and bottom borders, each track 18 including parallel side flanges 19 having formed in their confronting faces longitudinal ball race defining grooves 20. The bottom of the cross web 21 of track 18 terminates in a short perpendicular end wall 22 to the inside face of which is adhered a bumper or stop pad 23. Extending between the upper ends of track flanges 19 is a transverse shaft carrying a freely rotatable roller 24 whose periphery projects beyond the longitudinal edges of flanges 19.

Located in track 18 between flanges 19 is a longitudinally extending channel shaped retainer member 26 having an inner cross web 27 having formed therein a longitudinal medial rib 28 and being parallel to cross web 21. Regularly longitudinally spaced fingers 29 project laterally from the opposite edges of cross web 27 and terminate in somewhat longer upright wings 30, each wing 30 having a circular opening with inwardly laterally projecting retainer lips. Registering with each of the openings in wings 20, is a ball 32 which engages a respective track race 20 so that the ball carrying retainer member 26 is freely slidable along track 18.

A relatively short channel shaped follower 33 slidably engages retainer member 26 and includes an outer cross web 34 and inwardly directed side flanges 36 having race defining grooves formed in their outside faces engaged by balls 32 so that follower 33 is longitudinally slidable between the ends of track 18 as limited by bumper 23 and roller 24. Affixed atop follower cross web 34 is a block 37 on which is adjustably mounted a hinge bracket 38.

Bracket 38 includes a pair of parallel longitudinal side walls 39 embracing block 37 and a cross wall 40 extending between side walls 39 and overlying block 37. A first screw 41 engaging an opening in cross wall 40 and a tapped bore in block 37 adjustably secures bracket 38 to block 37 and an adjusting second screw 42 longitudinally offset from screw 41 engages a tapped opening in bracket cross wall 40 and bears on block 37 to permit the angular adjustment of bracket 38 on block 37. Projecting angularly forwardly downwardly from the front lower corners of side walls 39 and substantially coplanar therewith are a pair of transversely spaced parallel arms 43 terminating in rearwardly downwardly extending legs 44. Extending between and affixed to arms 43 are a first hinge pin 46 proximate the ends of legs 44, a second hinge pin 47 proximate the inner ends of legs 44 and a third hinge pin 48 located upwardly inwardly of second hinge pin 47 and spaced a greater distance from hinge pin 47 than is hinge pin 46.

A pair of laterally spaced anchor members 49 is provided each of which includes a body portion with a cylindrical wall 50 nesting in a corresponding circular opening in the front border of wall 12, a longitudinally extending medial rectangular well 51 extending diametrically across wall 50 and having parallel side walls 52 and a base wall 53 having at its front end a transverse opening 54. A pair of opposite wings 56 extend laterally from side walls 52 and are secured to the inside face of door 17 by screws. A pair of laterally extending vertically transversely spaced upper fourth and lower fifth hinge pins 56 and 57 respectively extend between and are journaled to side walls 52 in registry with the inner border of opening 54.

Figure 3:
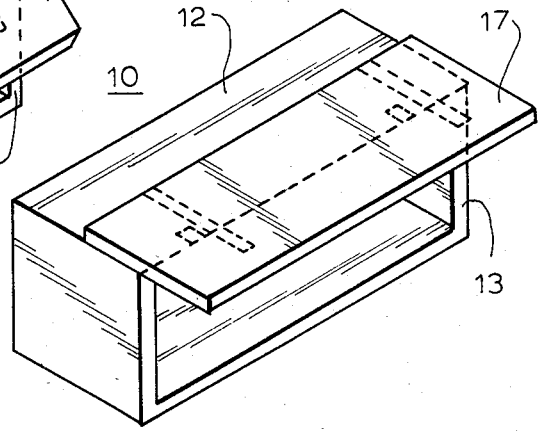
FIG. 3 is a front perspective view thereof with the door being shown in a fully open partially retracted position.
Figure 4:
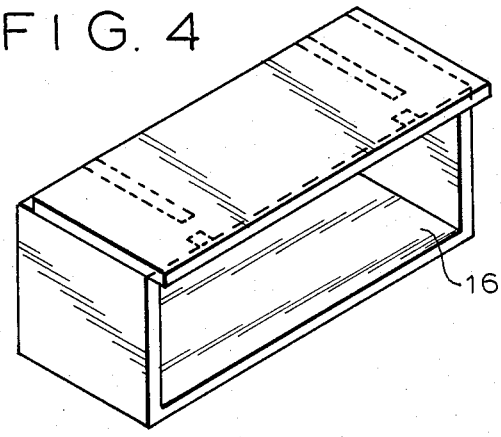
FIG. 4 is a front perspective view thereof with the door being shown in an open fully retracted position.
Figure 5:
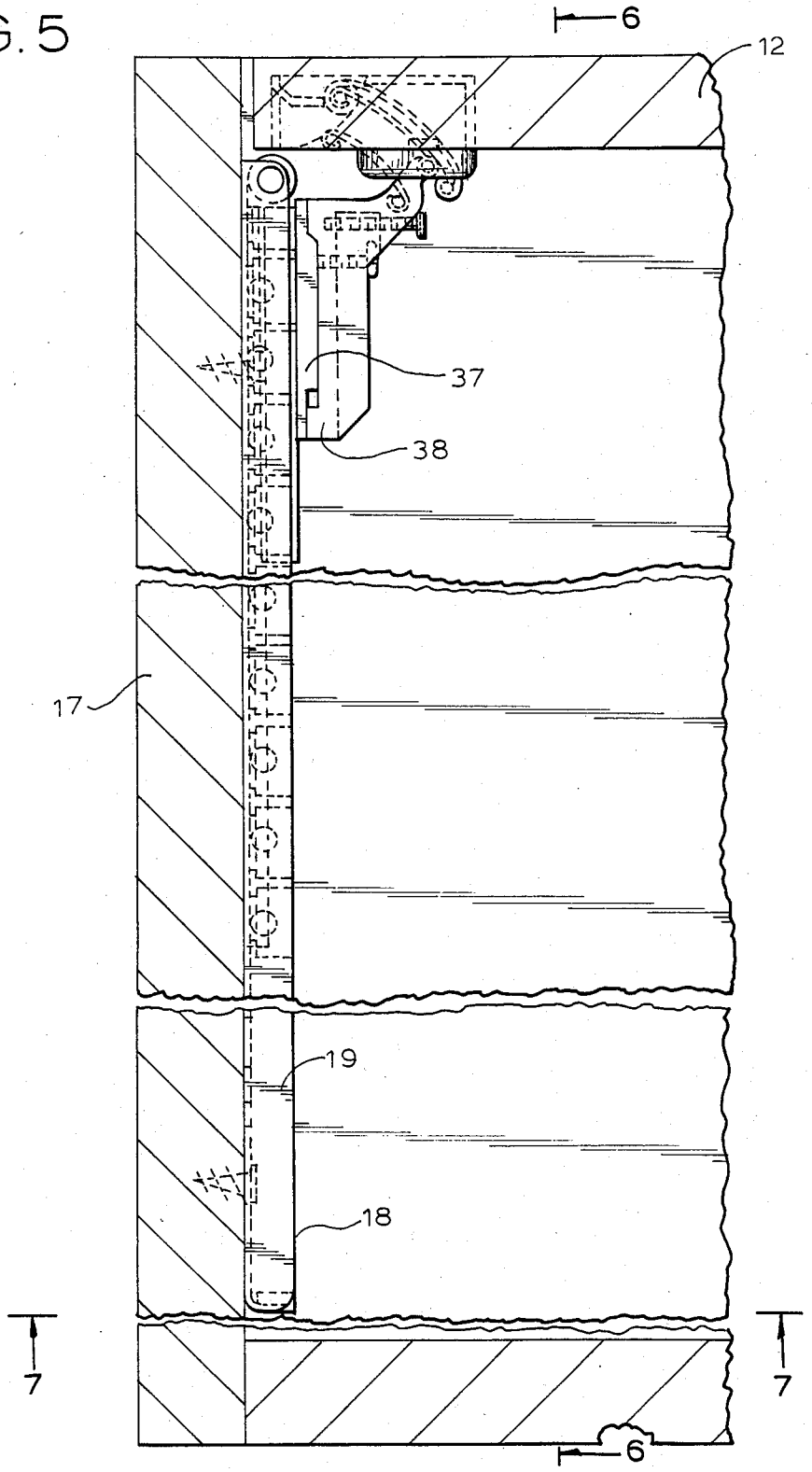
FIG. 5 is a fragmentory longitudinal forshortened detailed sectional view of the cabinet in the condition shown in FIG. 1.
Figure 6:
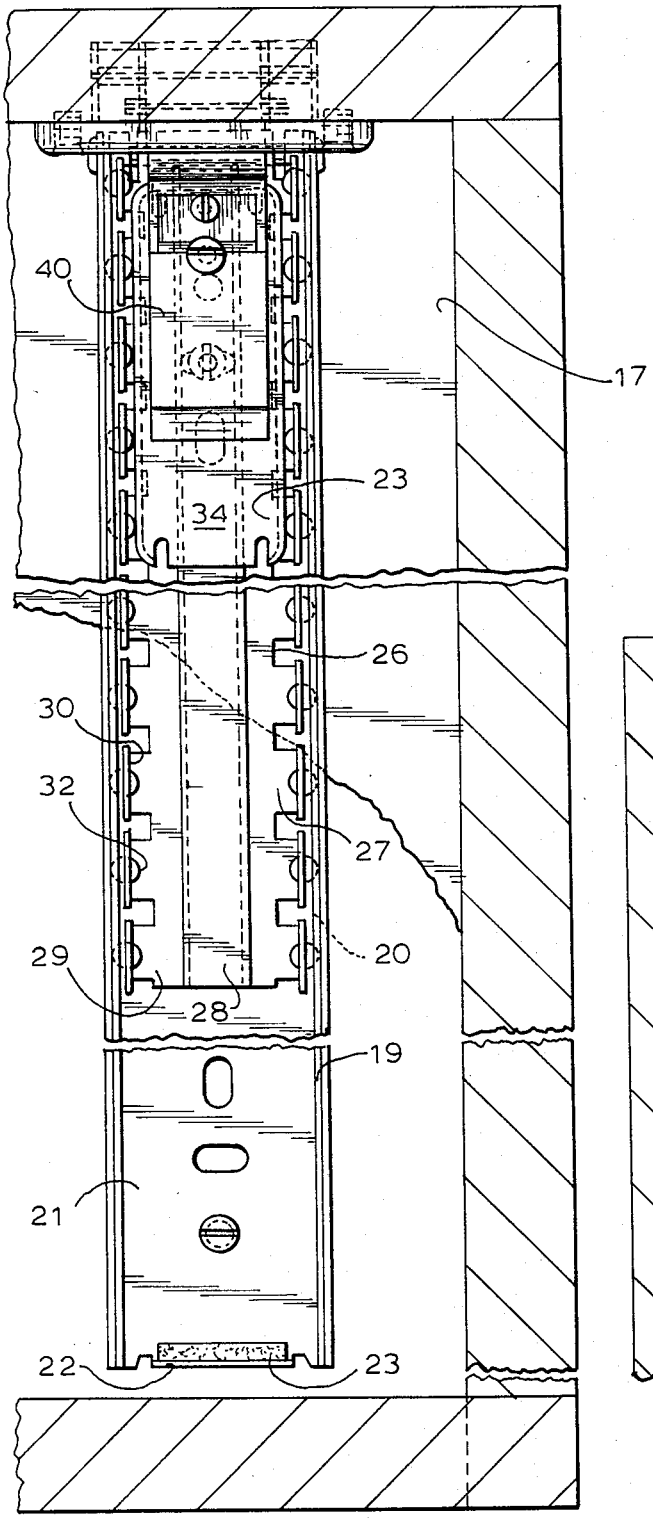
FIG. 6 is a sectional view taken along line 6—6 in FIG. 5.
Figure 7:
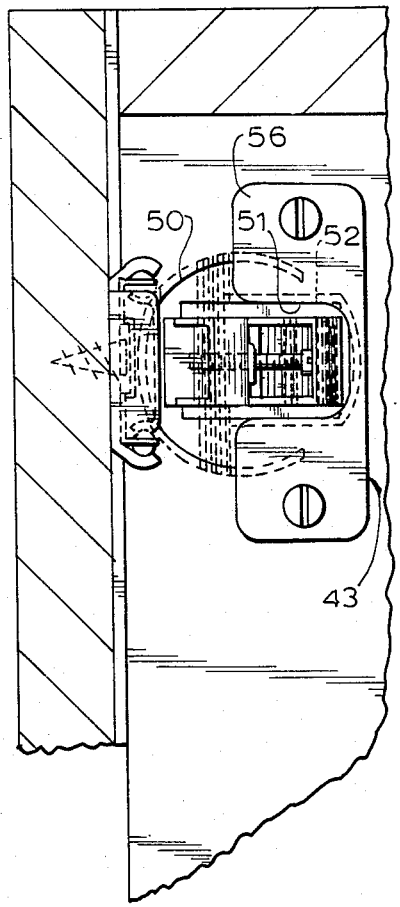
FIG. 7 is a sectional view taken along line 7—7 in FIG. 5.
Figure 8:
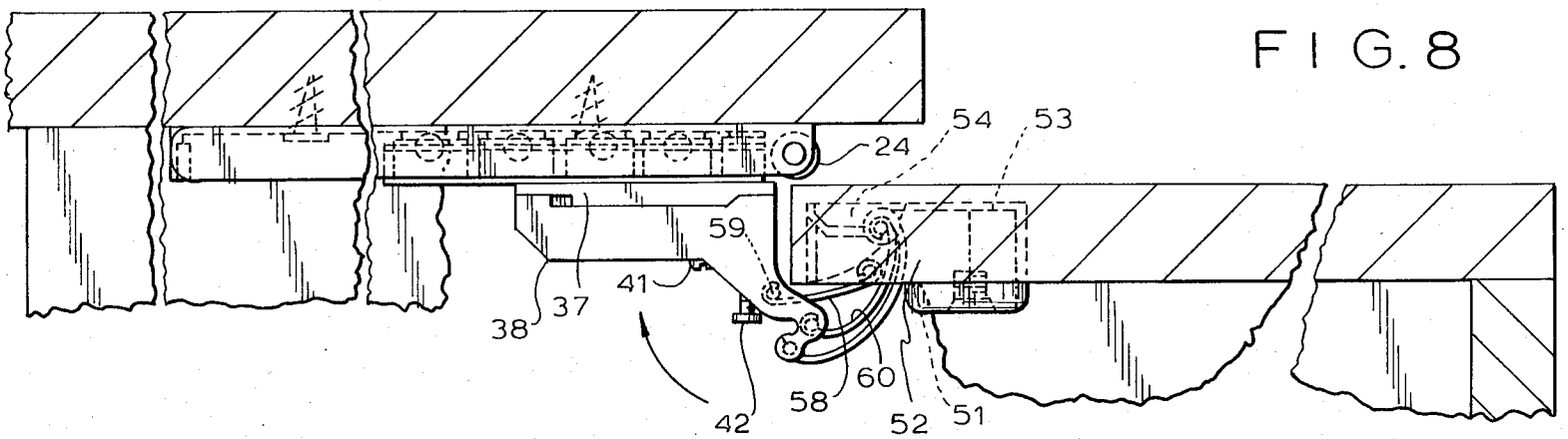
FIG. 8 is a view similar to FIG. 5 but with the door shown in an open advanced position.
Figure 9:
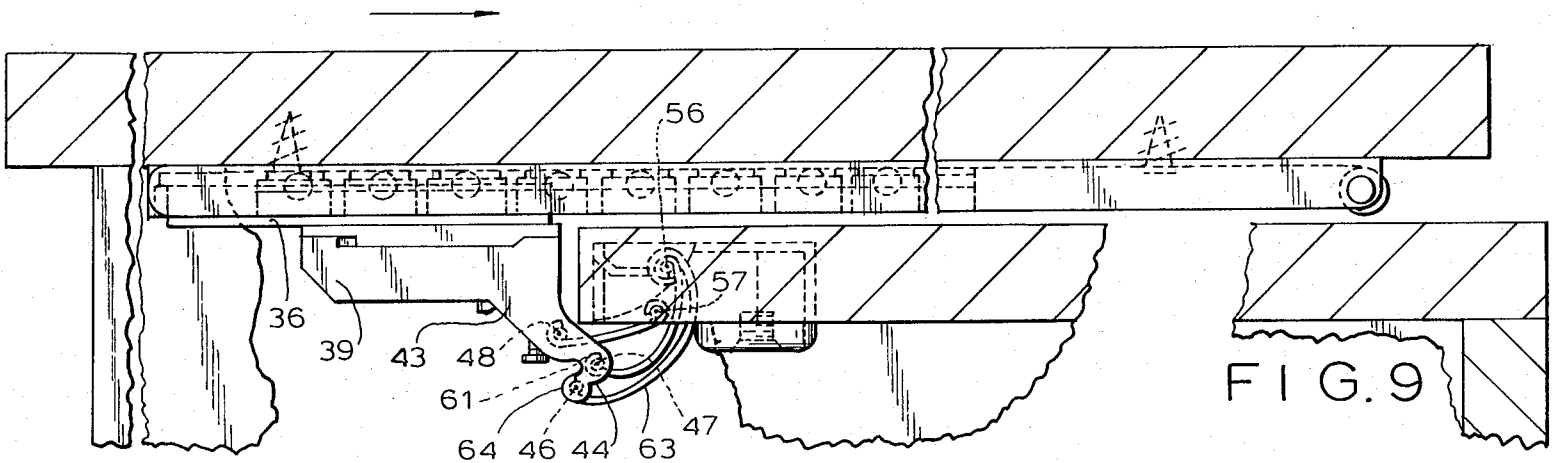
FIG. 9 is a view similar to FIG. 8 but with the door shown in an open retracted position.
Figure 10:
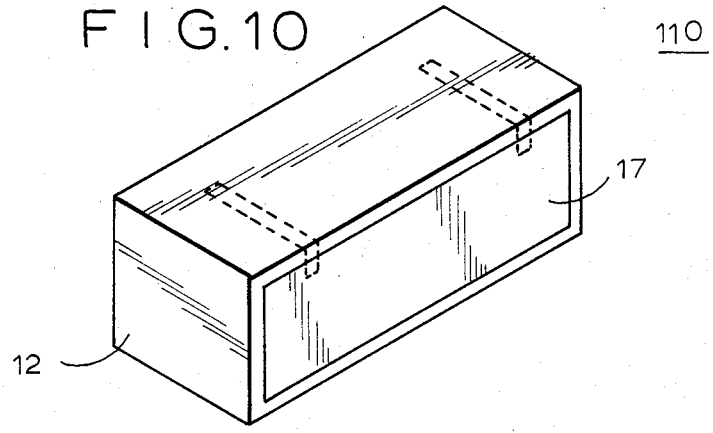
FIGS. 10 to 13 are similar to FIGS. 1 to 4 but of another embodiment of the present invention.
Figure 11:
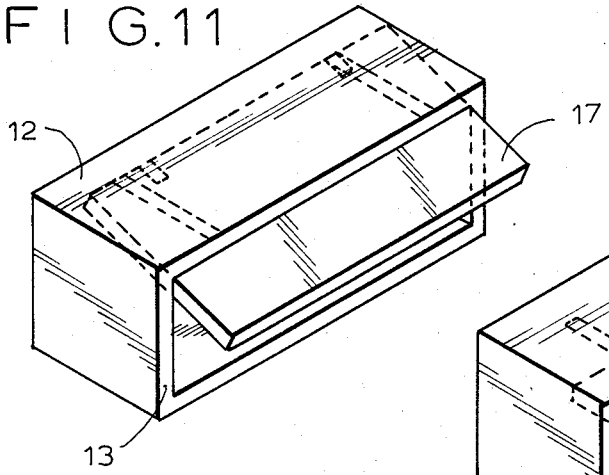
Figure 12:
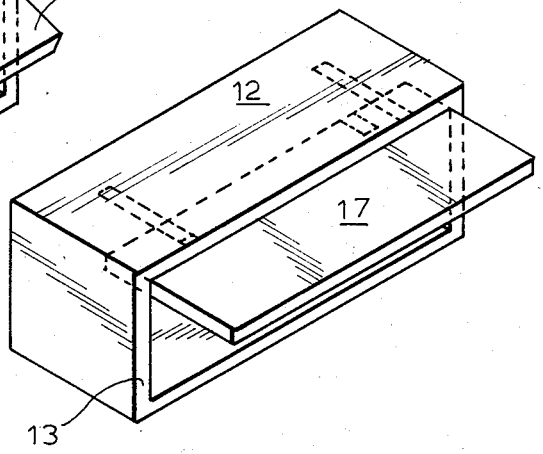
Figure 13:
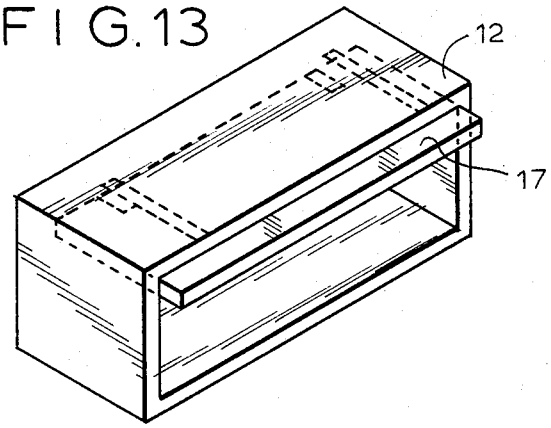
Figure 14:
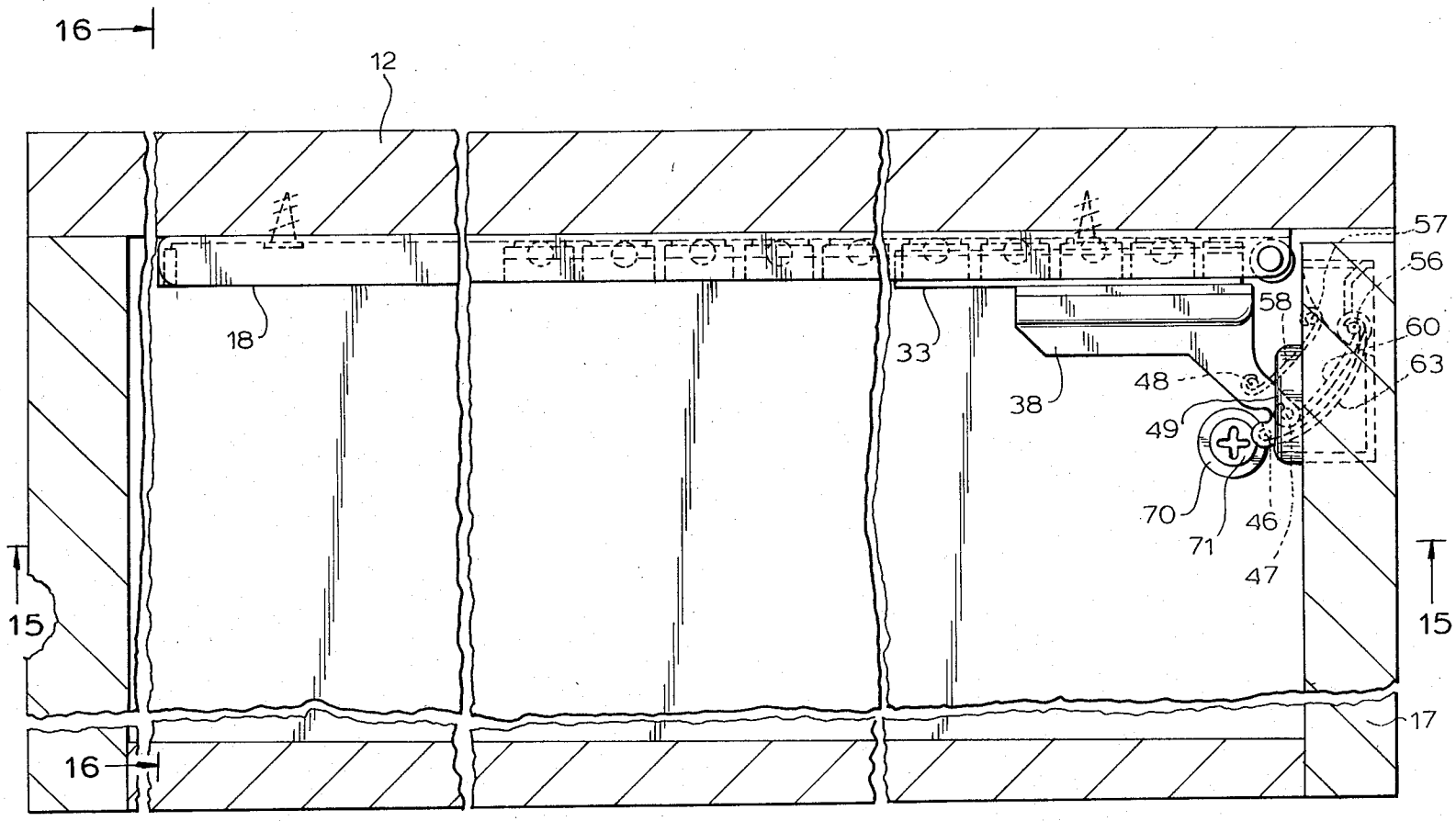
FIG. 14 is a fragmentary longitudinal forshortened detailed sectional view of the cabinet shown in FIG. 10.
Figure 15:
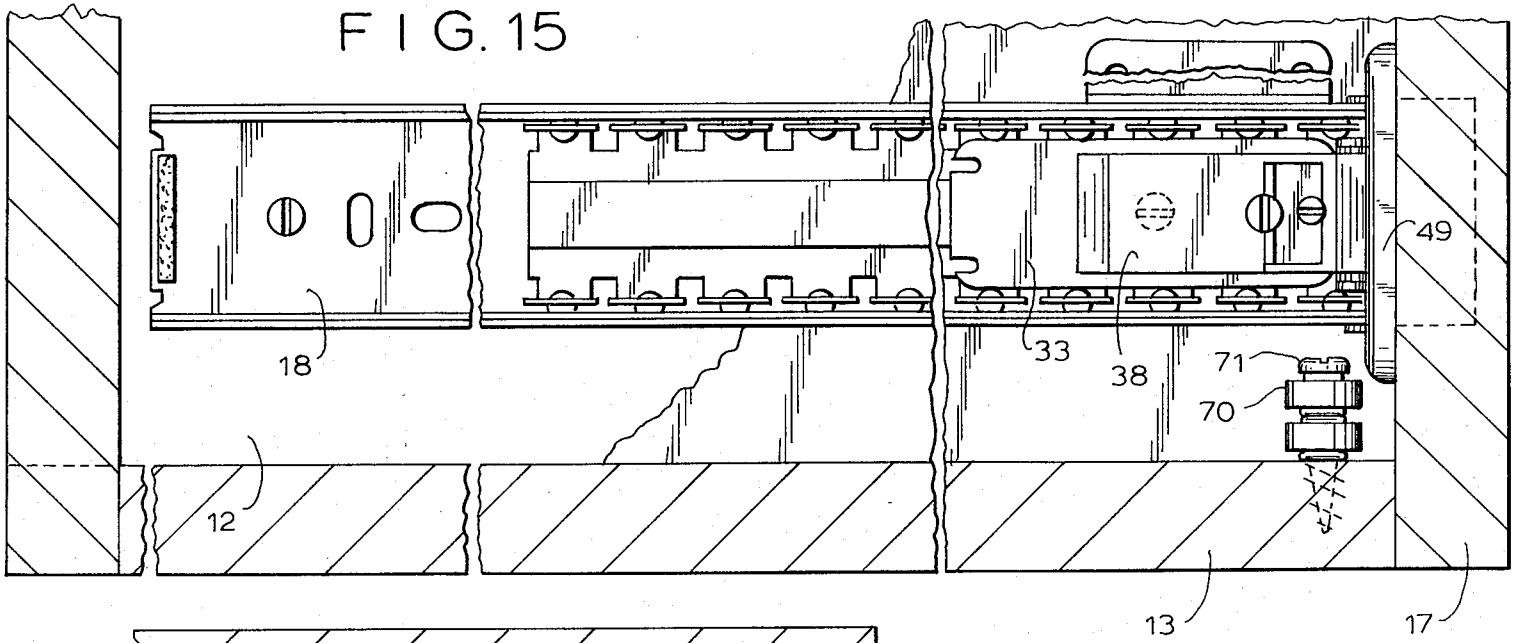
FIG. 15 is a sectional view taken along line 15—15 in FIG. 14.
Figure 16:
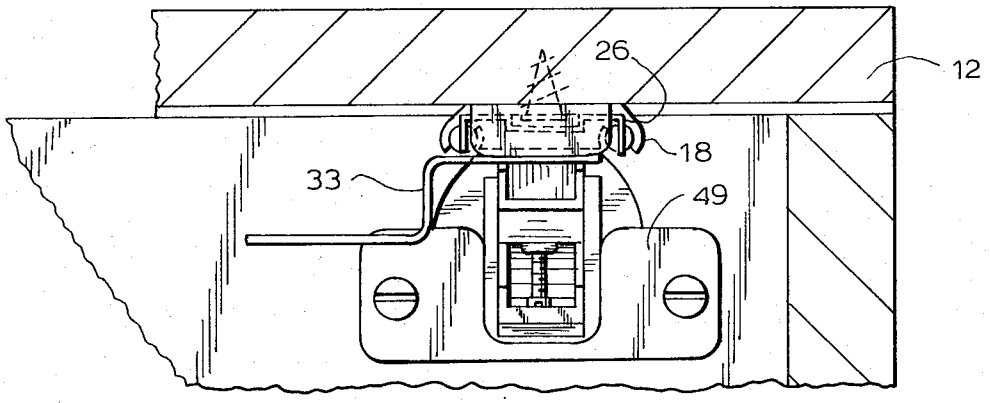
FIG. 16 is a sectional view taken along line 16—16 in FIG. 14.
Figure 17:
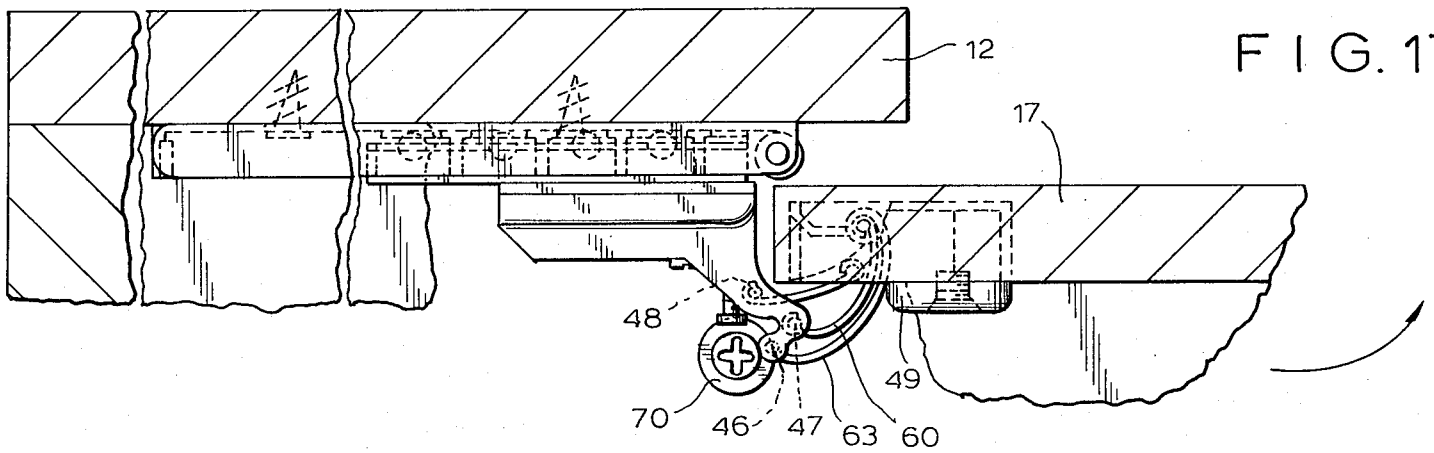
FIG. 17 is a view similar to FIG. 14 but with the door shown in an open advanced position.
Figure 18:
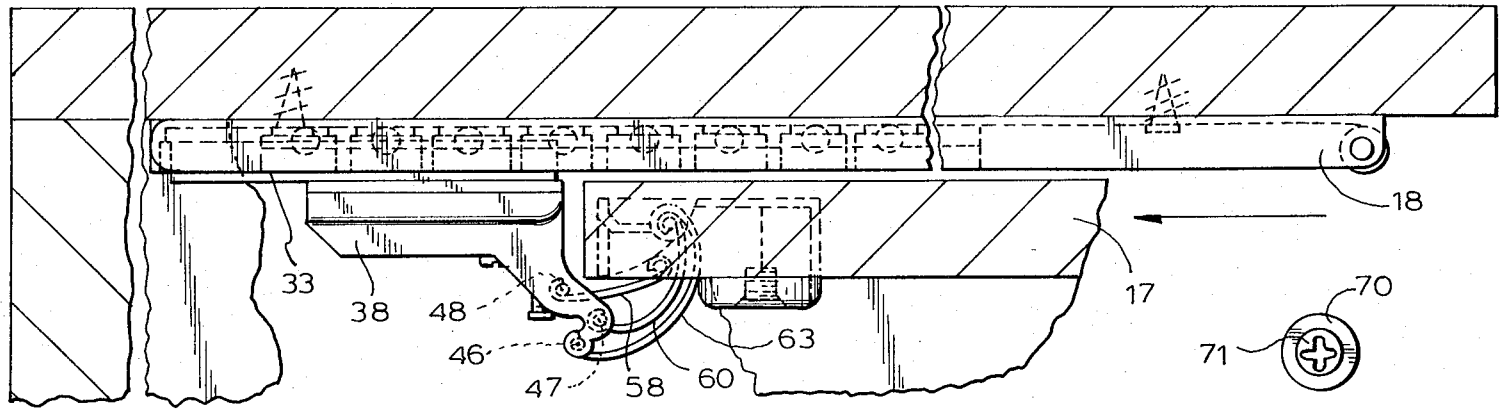
FIG. 18 is a view similar to FIG. 17 with the door shown in an open retracted position.

A first relatively short link 58 terminates at opposite ends in hooks or knuckles 59 which rotatably engage respective hinge pins 48 and 57 and a second relatively longer outwardly bowed link 60 terminates at opposide ends in hinge knuckles 61 which rotatably engage respective hinge pins 47 and 56. An outwardly bowed leaf spring 63 terminates at opposite ends in knuckles 64 which respectively rotatably engage hinge pin 46 and the outer face of the knuckle 64 engaging hinge pin 56. The hinge pins 47, 48, 56 and 57 and links 58 and 60 are so dimensioned and located that the door 17 swings relative to cabinet upper wall 12 between a vertical cabinet closing position as shown in FIG. 1 through the position shown in FIG. 2 where the door 17 extends above and forward of the front edge of wall 12 to a position above and parallel to top wall 12 where it may be slid to its fully retracted position as shown in FIG. 4. The leaf spring 63 is so dimensioned and positioned that it biases or urges the door to its closed position when the door is within a predetermined angle of such closed position and urges it somewhat toward its fully open position, as shown in FIG. 3 when it approaches such position.

The embodiment of the present invention illustrated in FIGS. 10 to 18 of the drawings differ from that first described only in that the track is located on the bottom face of the cabinet top wall and the hinge mechanism anchor member is located at the upper border of the door so that in operation the door, when swung to its open position is parallel to and below the top wall and is rearwardly retracted below the top wall. The same reference numerals are used to designate similar members in both embodiments.

Specifically, the modified cabinet 110 includes a rectangular top wall 12, side walls 13 and a front door 17. The tracks 18 are affixed to and extend longitudinally along the underface of top wall 12 and each track carries the longitudinally slidable retainer member 26 and follower 33 the adjustable bracket 38 depending from follower 33 and being provided with hinge pins 46, 47 and 48. The anchor members 49 nest in an opening in the upper border of door 17 and each is provided with hinge pins 56 and 57, links 58 and 60 joining pins 48 and 57, and 47 and 56 respectively and leaf spring 63 extending between hinge pins 46 and 56 in the manner earlier described. In all other respects the structure of the hinge slide mechanism last described is similar to that first described.

Mounted proximate the upper front border of the inside face of a side wall 13 are a pair of axially spaced resilient or elastomeric rollers 70 which are rotatably supported by an axil screw 71 secured to side wall 13. The rollers 70 function as a shock absorbing bumper when the door 17 is swung to its closed position and as a low friction support guide for the side border of door 17 when it is retracted or advanced in its open position.

While there have been described and illustrated preferred embodiments of the present invention it is apparent that numerous alterations, omissions and additions may be made without departing from the spirit thereof.

I claim:

1. A cabinet structure comprising:

a cabinet body including top, bottom and side walls whose front edges delineate a rectangular front opening, the top wall having top and bottom faces;

a rectangular door corresponding in shape to said cabinet body front opening; and coupling means swingably and slidably connecting said door and top wall; the improvement wherein said coupling means comprises an anchor member affixed to the underface of said top wall inwardly and proximate to said front opening, a bracket member, hinge means connecting said bracket member to said anchor member for swinging about a transverse axis between a vertical closed position depending from said anchor member and a horizontal open position projecting forwardly of and at about the level of said anchor member, said hinge means including a plurality of transversely spaced first hinge pins located on said anchor member, a plurality of transversely spaced second hinge pins located on said bracket member, a pair of link members extending between respective pair of said first and second hinge pins whereby said door in its open position is spaced above said top wall and a leaf spring extending between a pair of said first and second pins and urging said door to its closed position when at less than a predetermined angle to the vertical, a follower mounted on and angularly adjustable relative to said bracket member and projecting upwardly when said bracket member is in open position and being below the level of said top wall when said bracket member is in closed position and a track affixed to the inside face of said door and forwardly rearwardly slidably engaging said follower whereby said door is swingable between a vertical closed position registering with said front opening and an open position above and parallel to said top wall and being forwardly and rearwardly slidable.

2. A cabinet structure comprising:

a cabinet body including top, bottom and side walls whose front edges delineate a rectangular front opening, the top wall having top and bottom faces;

a rectangular door corresponding in shape to said cabinet body front opening; and coupling means swingably and slidably connecting said door and top wall; the improvement wherein said coupling means comprises an anchor member affixed to the upper border of the inside face of said door, a bracket member, hinge means connecting said anchor member to said bracket member for swinging about a transverse axis between a vertical closed position forwardly of said bracket member and a horizontal open position at about the level of said bracket member, said hinge means including a plurality of transversely spaced first hinge pins located on said anchor member, a plurality of transversely spaced second hinge pins located on said bracket member, a pair of link members extending between respective pair of said first and second hinge pins whereby said door in its open position is spaced below said top wall and a leaf spring extending between a pair of said first and second pins and urging said door to its closed position when at less than a predetermined angle to the vertical, a track follower mounted on and angularly adjustable relative to and projecting upwardly from said bracket member and a forwardly rearwardly extending track affixed to the underface of said top wall and forwardly rearwardly slidably engaging said follower whereby said door is swingable between a vertical closed position registering with said front opening and an open position below and parallel to said top wall and being forwardly and rearwardly slidable.

3. The cabinet structure of claim 2 including a guide member mounted on at least one of said side walls and slideably engaging the underface of said door in the open position of said door.

* * * * *